US008083655B2

(12) United States Patent
Hoebel

(10) Patent No.: US 8,083,655 B2
(45) Date of Patent: Dec. 27, 2011

(54) TRAINING DEVICE FOR BUILDING UP THE MUSCULATURE OF THE LOCOMOTOR SYSTEM

(75) Inventor: Otto Hoebel, Hochdorf (DE)

(73) Assignee: medica-Medizintechnik GmbH, Hochdorf (DE)

( * ) Notice: Subject to any disclaimer, the term of this patent is extended or adjusted under 35 U.S.C. 154(b) by 0 days.

(21) Appl. No.: 12/467,602

(22) Filed: May 18, 2009

(65) Prior Publication Data

US 2009/0318271 A1 Dec. 24, 2009

(30) Foreign Application Priority Data

Jun. 21, 2008 (DE) ..... 10 2008 029 572

(51) Int. Cl.
*A63B 21/04* (2006.01)
*A63B 21/02* (2006.01)

(52) U.S. Cl. ..... 482/129; 482/121

(58) Field of Classification Search ..... 482/44–53, 482/79–80, 91–94, 97–100, 111–113, 121–130, 482/133, 135, 142, 145–146, 81–90; 601/23, 601/27, 33–34; D21/662, 673, 685, 692–693; *A63B 21/02, 21/04, 71/00*

See application file for complete search history.

(56) References Cited

U.S. PATENT DOCUMENTS

| | | | | |
|---|---|---|---|---|
| 2,620,188 | A * | 12/1952 | Malagio | 473/442 |
| 7,086,996 | B2 * | 8/2006 | Matjacic et al. | 482/69 |
| 7,559,881 | B1 * | 7/2009 | Roraff | 482/129 |
| 7,749,142 | B2 * | 7/2010 | Kuhagen | 482/129 |
| 2004/0209751 | A1 * | 10/2004 | Thonn, Jr. | 482/140 |
| 2006/0084554 | A1 * | 4/2006 | Bement | 482/79 |
| 2007/0287606 | A1 * | 12/2007 | Mac Millan | 482/97 |

* cited by examiner

*Primary Examiner* — Stephen Crow
*Assistant Examiner* — Oren Ginsberg
(74) *Attorney, Agent, or Firm* — Muncy, Geissler, Olds & Lowe, PLLC

(57) ABSTRACT

In a device for training the musculature of the human locomotor system, comprising a support unit which is at least indirectly attached at one end to a holding arm and at the other end can be releasably attached to a patient, wherein the holding arm is at least indirectly mounted, at its bottom end remote from the support unit, on a carrier chassis by means of at least one resilient element, training of walking or running movements implementing natural movement dynamics without risk of stumbling or falling is made possible in that a resilient element is coupled to at least one stabilizing assembly, which prevents torsion of the holding arm about its longitudinal axis and also restricts movement of the holding arm such that the end of the holding arm remote from the carrier chassis is capable of movement over a predetermined area and the support unit pivotally attached to the holding arm is thereby capable of movement within a predetermined volume.

26 Claims, 11 Drawing Sheets

TRAINING DEVICE FOR BUILDING UP THE MUSCULATURE OF THE LOCOMOTOR SYSTEM

BACKGROUND OF THE INVENTION

The invention relates to a device for training the musculature of the human locomotor system, comprising a support unit that is at least indirectly connected to a holding arm and can be releasably attached to a patient, which holding arm is mounted, in the region of its bottom end remote from the support unit, on a carrier chassis by means of at least one resilient element. The support unit is usually releasably attached to the patient in the hip region.

Devices of the kind mentioned above are used in the prior art to help persons suffering from fear of falling to train the musculature of their locomotor system (for example together with a treadmill) and also to train their sense of balance and their spatial orientation.

In the prior art, standing trainers are used for this purpose, in which patients can be held in a fixed position. However, this does not allow for training of a dynamic series of movements. Also known are balance trainers for achieving "dynamic standing", these being used for paralyzed patients such as, in particular, patients in wheelchairs.

Muscle training appliances comprising holding brackets are also known in which the patient can stand unsupported. However, such devices are suitable only for patients who are already capable of standing steadily.

A device of the aforementioned type is disclosed in EP 1 305 087. This prior device suffers from the drawback that two holding arms are necessary for a sequence of functional movements, so that the device is bulky, heavy, and expensive to manufacture.

SUMMARY OF THE INVENTION

It is thus an object of the invention to provide a muscle training device which makes it possible to train walking or running movements implementing natural movement dynamics without risk of stumbling or falling, said device being compact and light in weight.

According to the invention this object is achieved in that a resilient element is coupled to at least one stabilizing assembly which prevents torsion of the holding arm about its longitudinal axis and also restricts movement of the holding arm such that that end of the holding arm which is remote from the carrier chassis is capable of movement over a predetermined area and the support unit pivotally attached to said holding arm is thereby capable of movement within a predetermined volume.

Preferred embodiments of the invention are subject matter of the subclaims.

Due to the combination of features comprising a resilient element coupled to at least one stabilizing assembly which prevents torsion of the holding arm about its longitudinal axis and also restricts movement of the holding arm such that that end of the holding arm which is remote from the carrier chassis is capable of movement over a predetermined area and the support unit pivotally attached to said holding arm is thereby capable of movement within a predetermined volume, the device of the invention makes it possible for a patient to carry out standing, walking or running exercises to train his locomotor system while standing with his full body weight on a base. This means that full demands are imposed on the patient's spatial coordination and his sense of balance, just as would be the case during free progressive movement, which properties are thus trained accordingly.

At the same time, the support unit will cushion a fall of the patient, since the support unit and thus the hip of the patient can only move in a predetermined safety region, which can be set by the radius of the circle in which the support unit is free to move. The patient is thus safely prevented from stumbling, although he feels his full body weight during movement training.

The support unit is preferably attached, not necessarily pivotally, to one end of a support arm, the other end of which is pivotally attached to one end of the holding arm.

In a further preferred embodiment of the invention, a stabilizing assembly for limiting the movement of the holding arm includes a motion restrictor acting on the holding arm. The motion restrictor is preferably in the form of a ring so as to configure said predetermined area of movement as a circle. The motion restrictor can preferably be formed by the face end of a hollow cylinder in which the resilient element is disposed. Alternatively, the motion restrictor might be designed so as to configure said predetermined area as a polygon.

In the device of the invention, a resilient element can be in the form of, say, a spiral spring and/or a block of resilient plastics material.

In the above embodiment of the invention, a stabilizing assembly for limiting the movement of the holding arm preferably includes two interconnected pivot joints, which are arranged such that each allows for movement in a plane perpendicular to the other and permits movement of the support unit in two directions of rotation, again mutually at right angles. One part of a first pivot joint is connected at least indirectly to the carrier chassis, whilst one part of a second pivot joint is pivotally connected at least indirectly to the holding arm.

Furthermore, an at least indirectly pivotal connection between one part of the second universal joint and the holding arm comprises two pivot joints each arranged so as to allow for movement in a common plane.

In another preferred embodiment of the invention, a stabilizing assembly includes a carrier element mounted for rotation about its longitudinal axis. The bottom end of the holding arm is pivotally connected to the carrier element. The swivel axis of the holding arm is preferably perpendicular to the longitudinal axis of the carrier element. The carrier element is in the form of an elongated panel that is connected at each end to the carrier chassis via pivot joints.

In this embodiment of the invention, there is at least one expandable and compressible resilient element that is connected at one end to the carrier element and at the other end to the carrier chassis so as to urge the carrier element into a predetermined home position. Preferably, two resilient elements are located opposite each other and are expandable in opposite directions, each of the resilient elements being connected at one end to the carrier element and at the other end to the carrier chassis. These resilient elements cooperate so as to urge the carrier element into a predetermined home position.

A further expandable and compressible resilient element can preferably be provided which is attached at one end to the carrier element and at the other end to the holding arm so as to urge the holding arm into a predetermined home position. Here again, two expandable resilient elements are located opposite each other and are expandable in opposite directions, each of the resilient elements being attached at one end to the carrier element and at the other end to the holding arm, cooperating so as to urge the holding arm into a predetermined home position.

In the above embodiment of the invention, a pivot joint for pivotal mounting of the carrier element and a pivot joint for pivotal mounting of the holding arm are each preferably provided with an element that limits the pivot angle, so that that end of the holding arm which is remote from the carrier chassis is capable of movement over a predetermined area and the support unit pivotally connected to the holding arm is thereby capable of movement within a predetermined volume.

BRIEF DESCRIPTION OF THE DRAWINGS

The device of the invention is described below with reference to two preferred embodiments illustrated in the drawings, in which.

DETAILED DESCRIPTION

Figure 1:
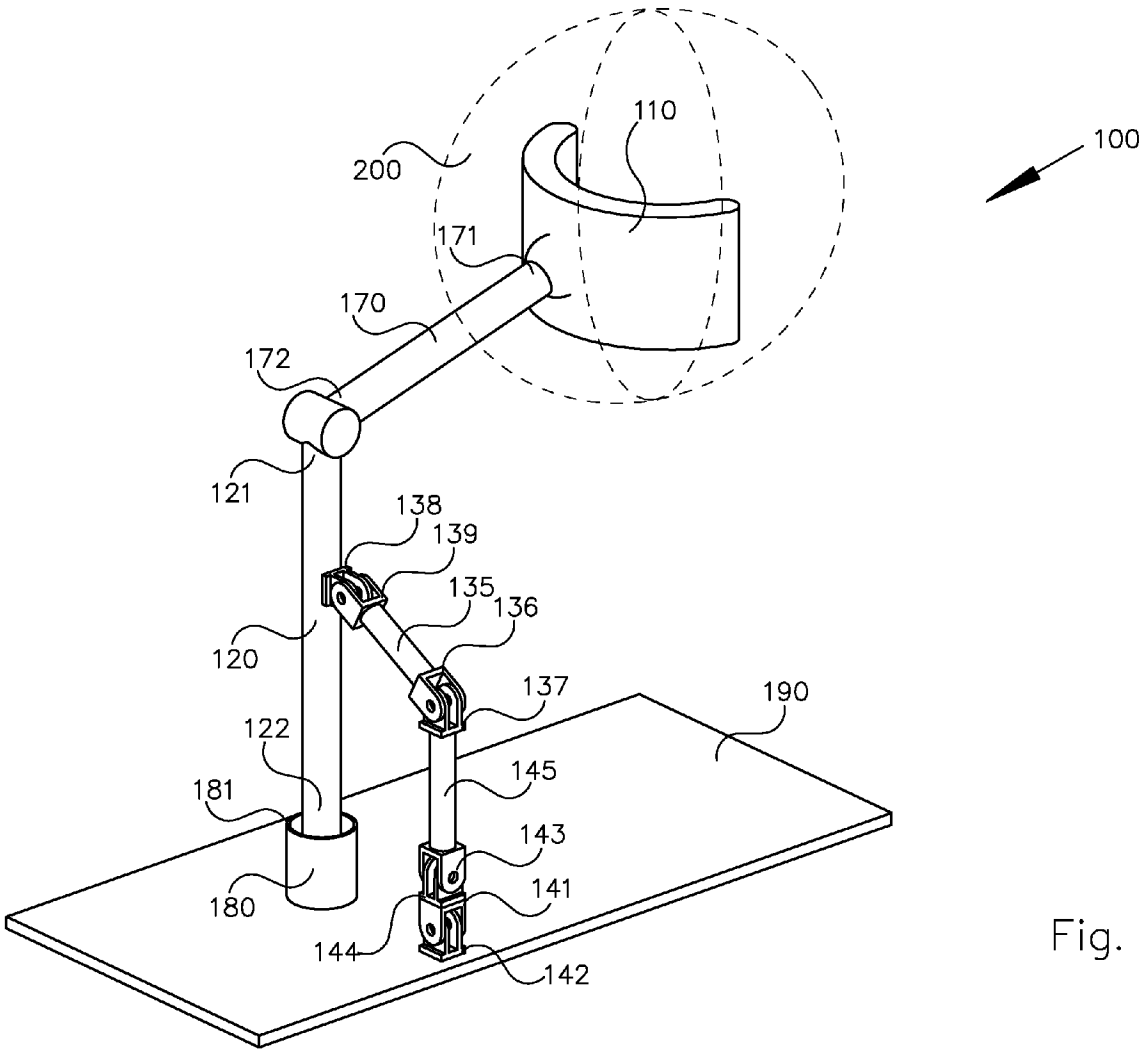
FIG. 1 shows a first preferred embodiment of the device of the invention in an oblique view from above.
Figure 2A:
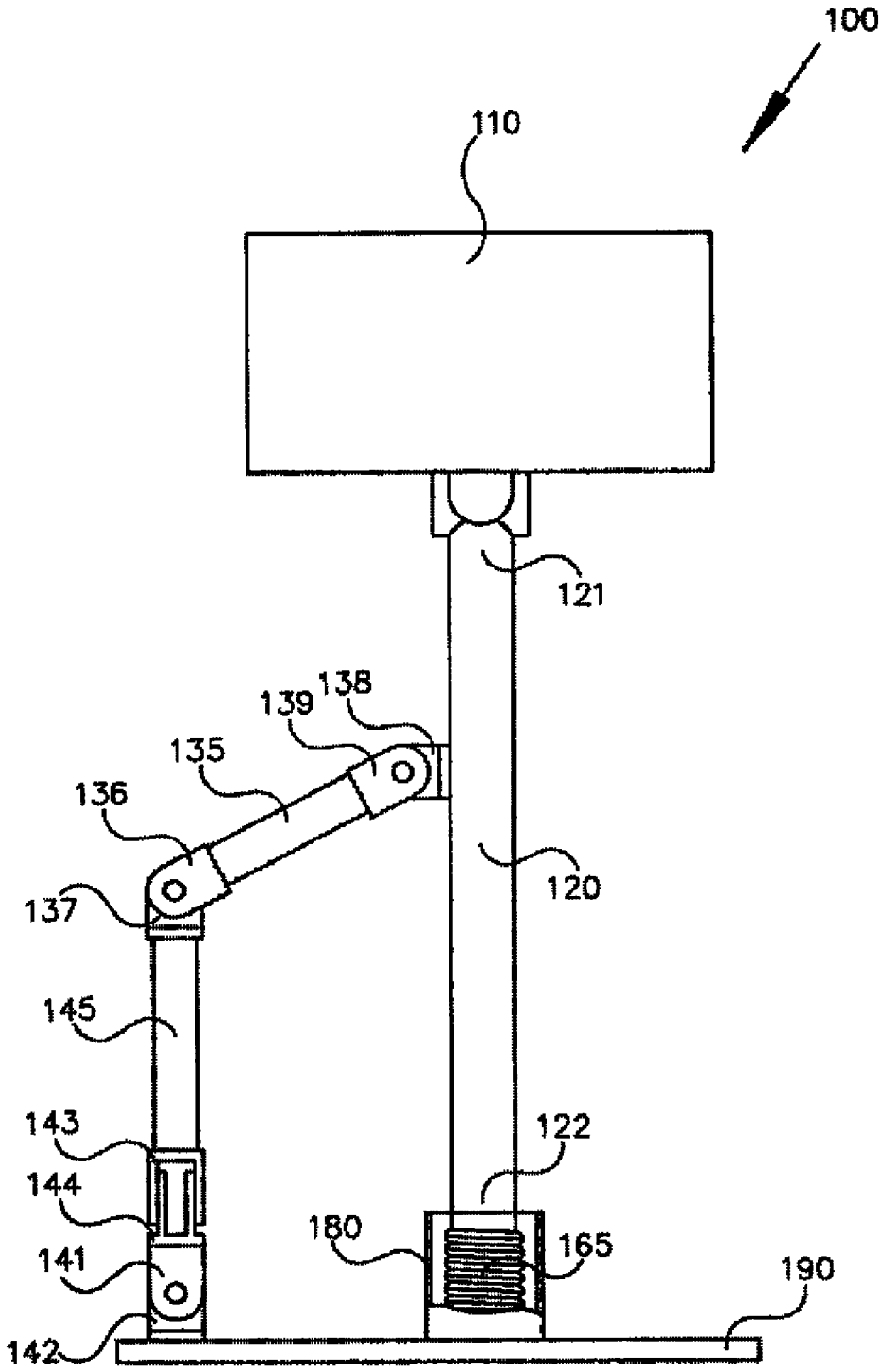
FIG. 2A shows a first preferred embodiment of the device of the invention in a view from the front.
Figure 2B:
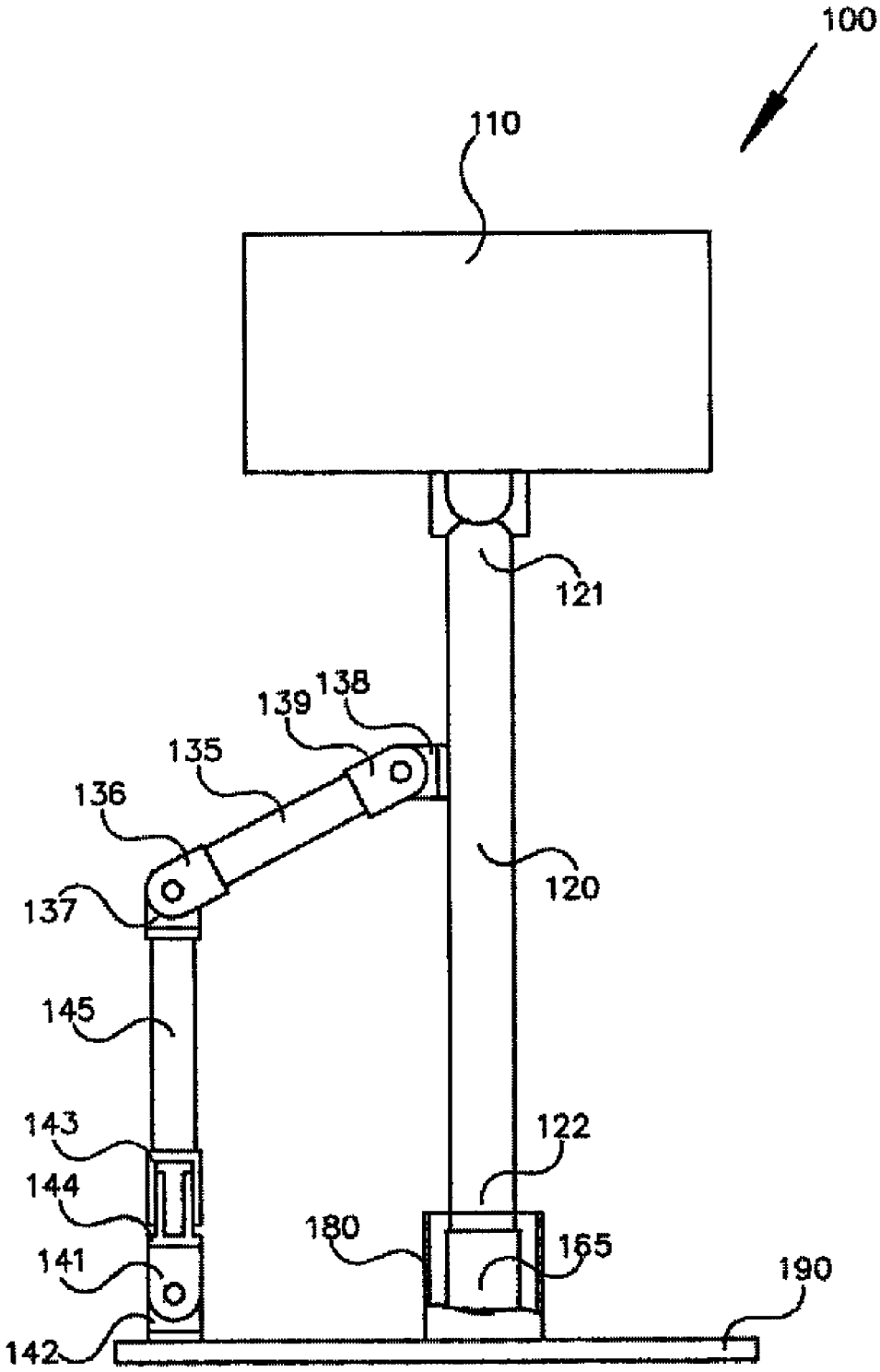
FIG. 2B shows an alternative resilient element for the device in a view from the front.
Figure 3:
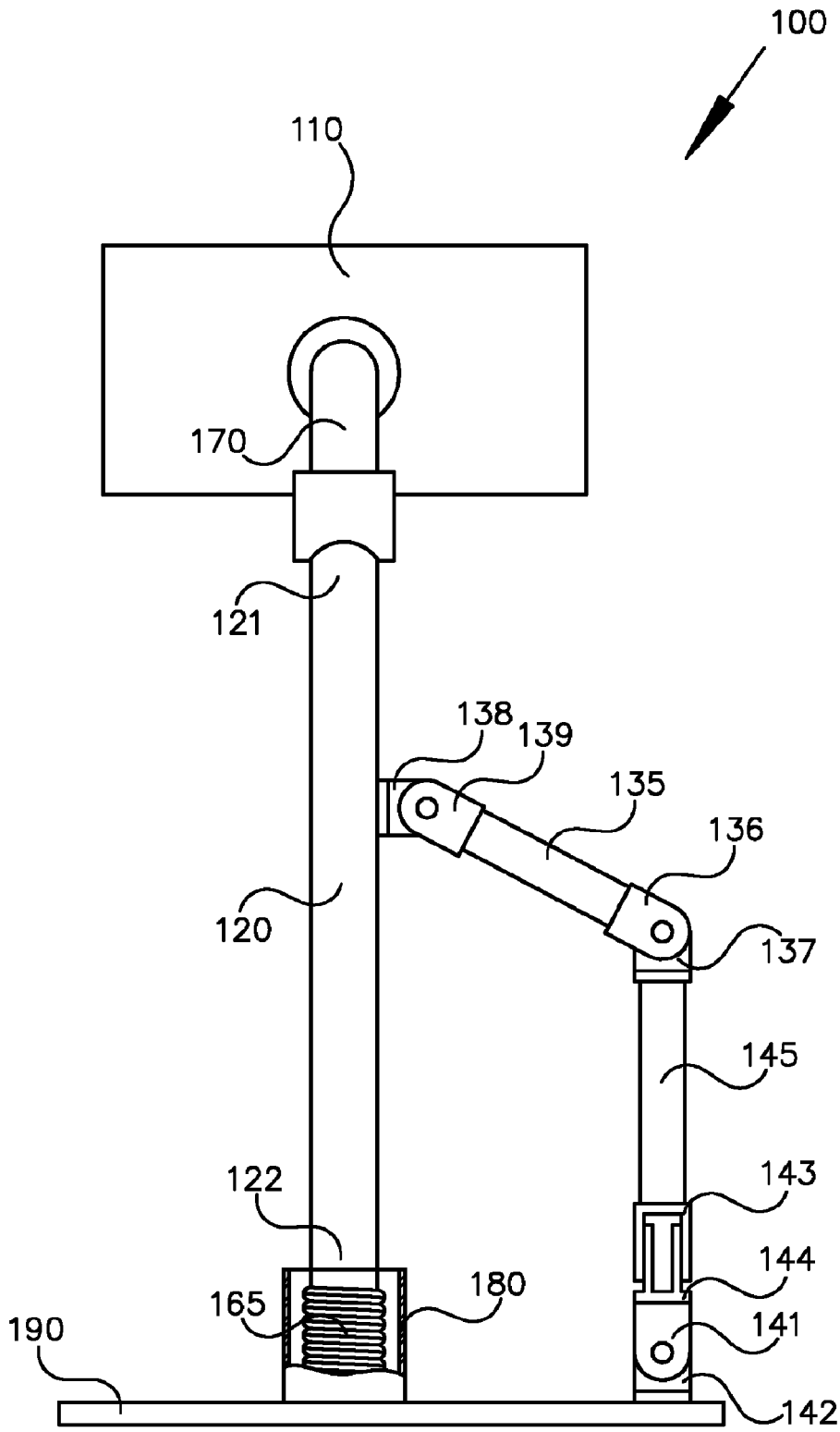
FIG. 3 shows a first preferred embodiment of the device of the invention in a view from the rear.
Figure 4:
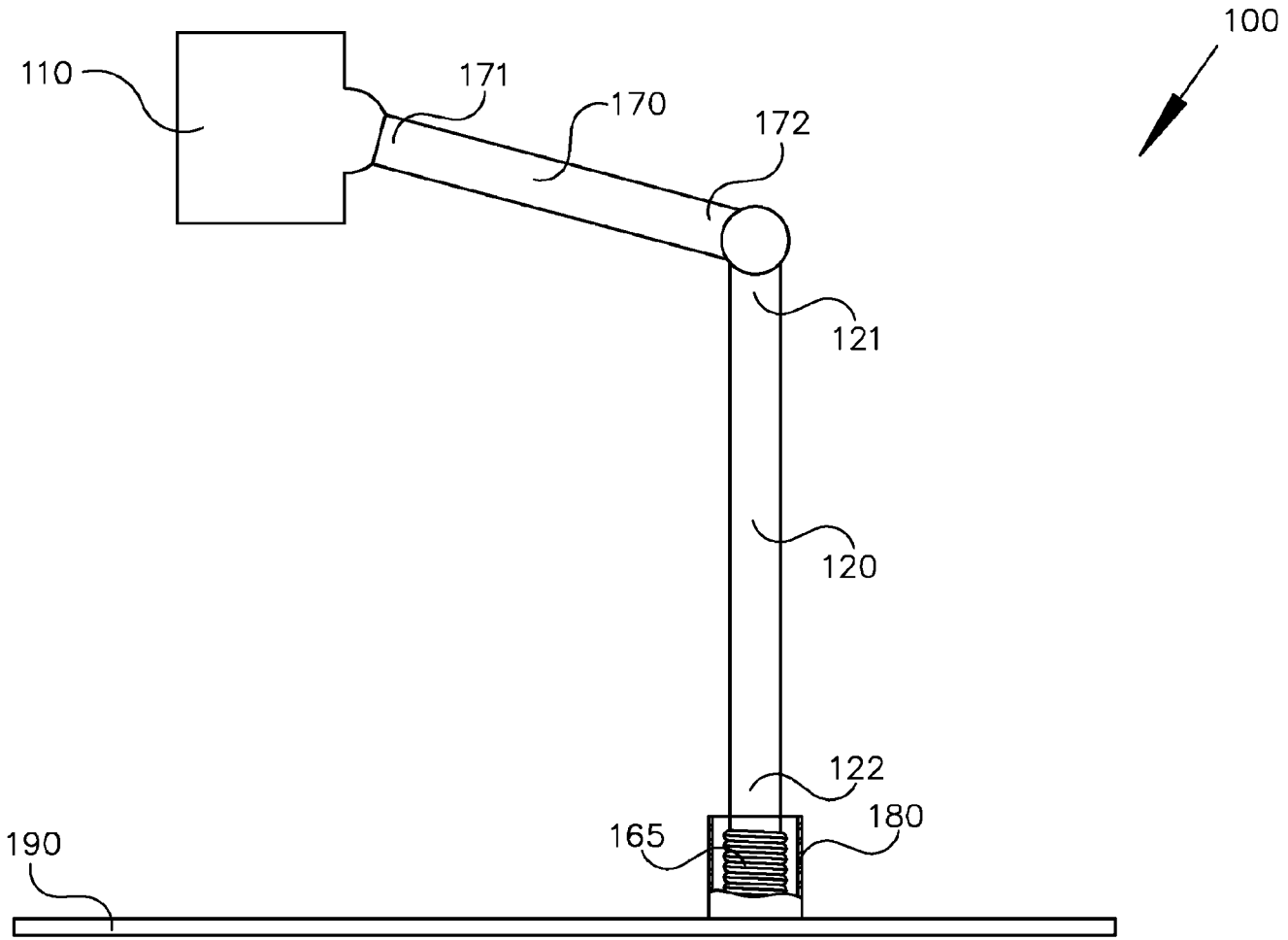
FIG. 4 shows a first preferred embodiment of the device of the invention in a view from the side.
Figure 5:
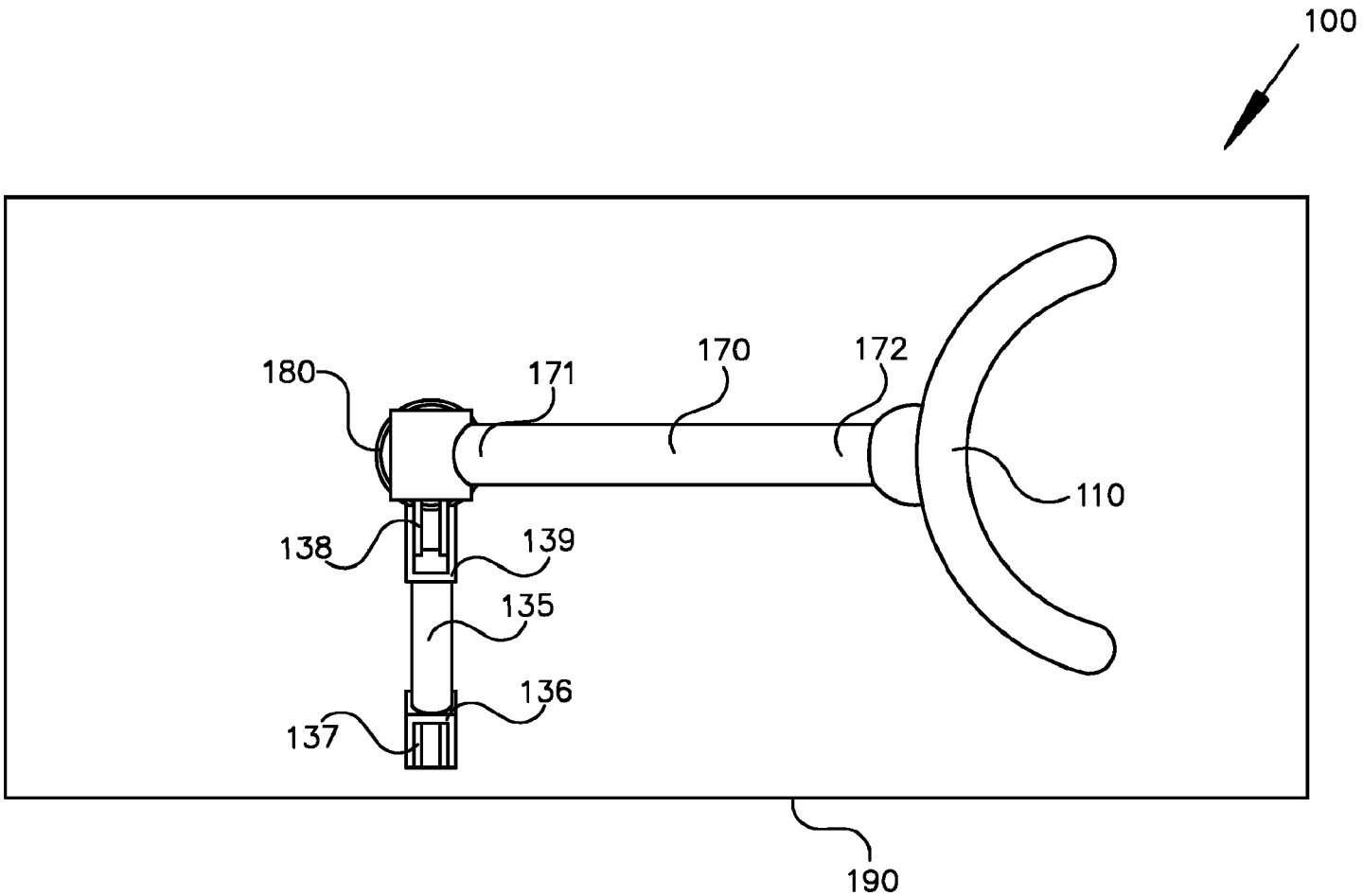
FIG. 5 shows a first preferred embodiment of the device of the invention in a view from above.
Figure 6:
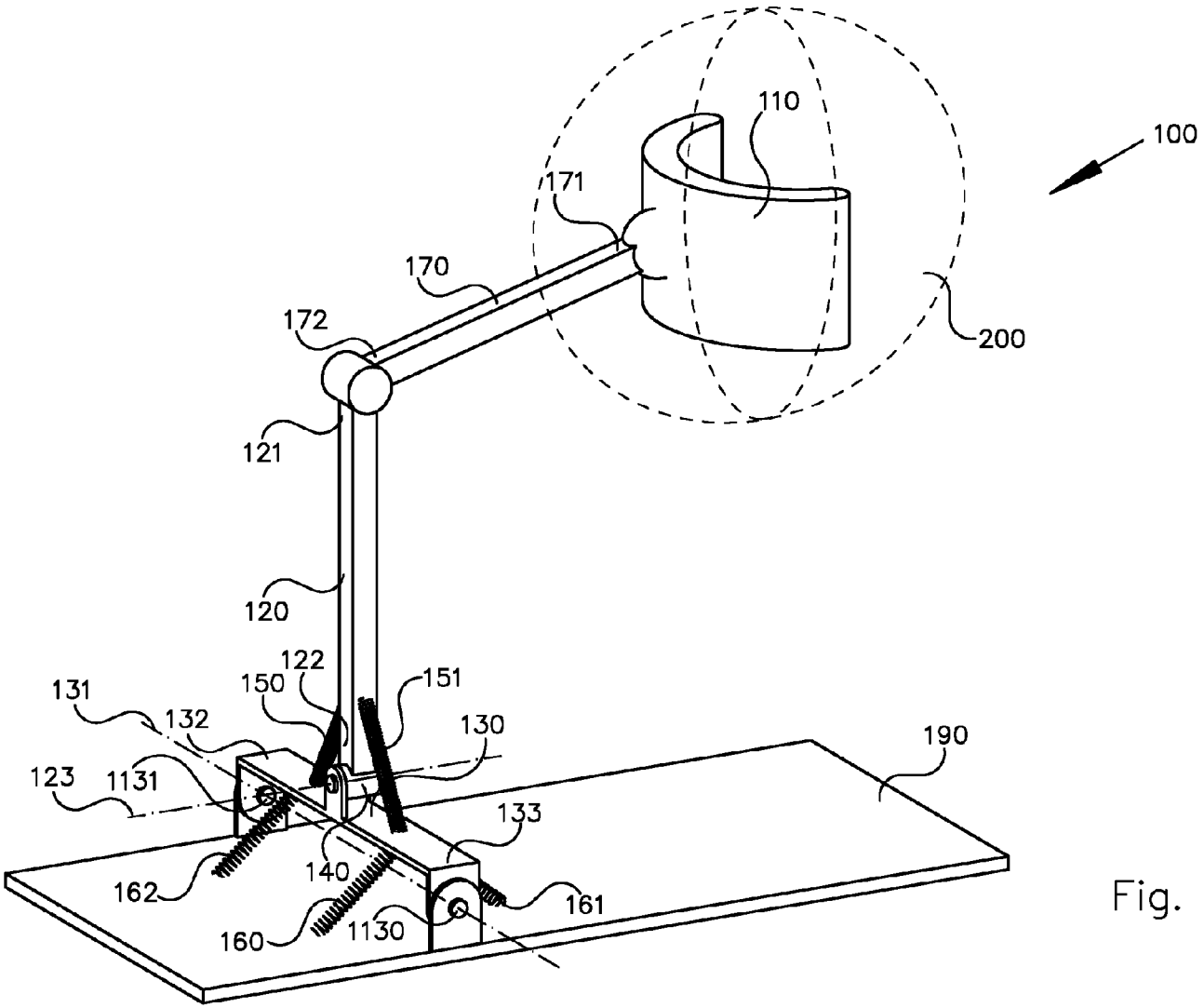
FIG. 6 shows a second preferred embodiment of the device of the invention in an oblique view from above.
Figure 7:
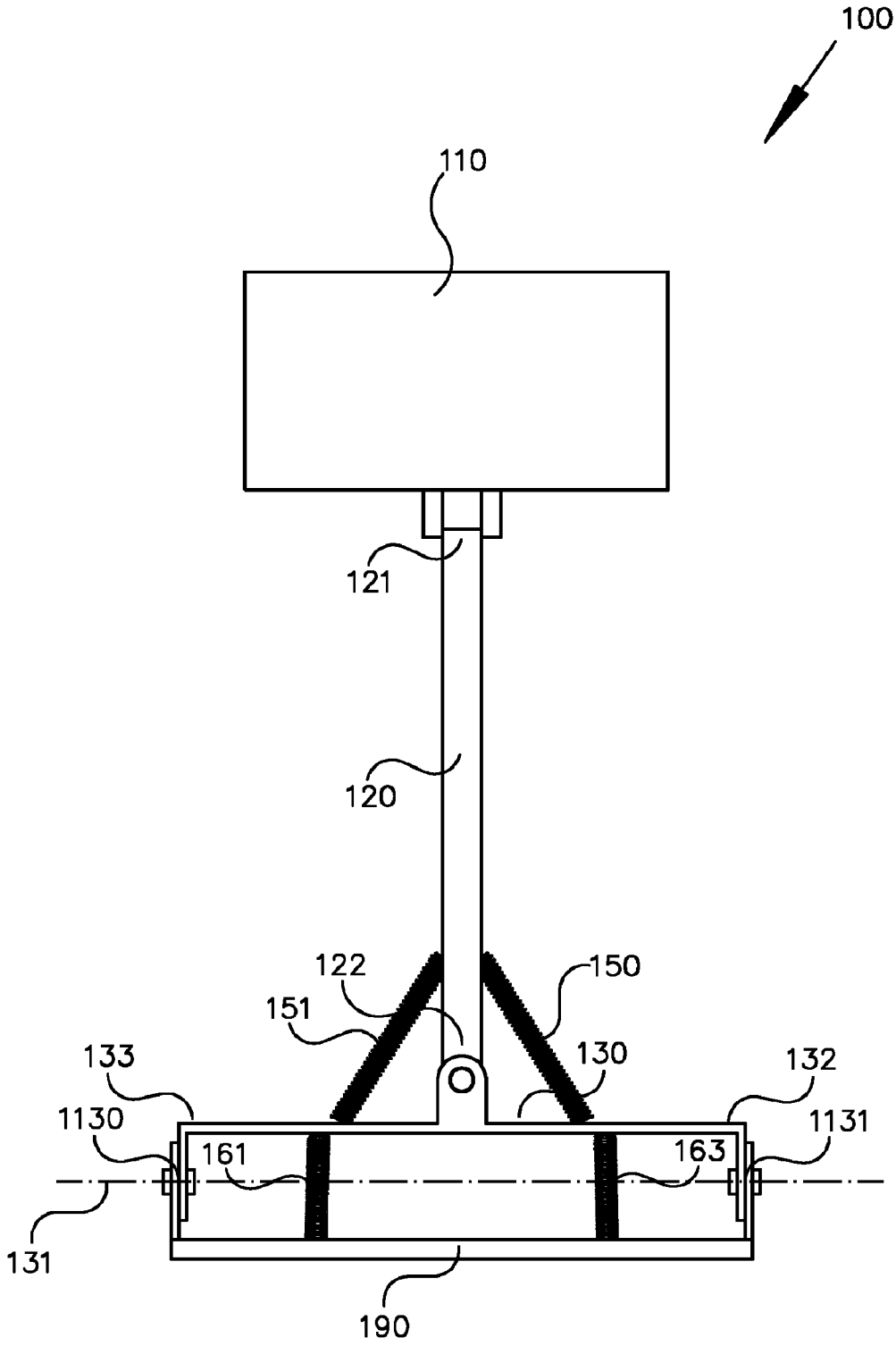
FIG. 7 shows a second preferred embodiment of the device of the invention in a view from the front.
Figure 8:
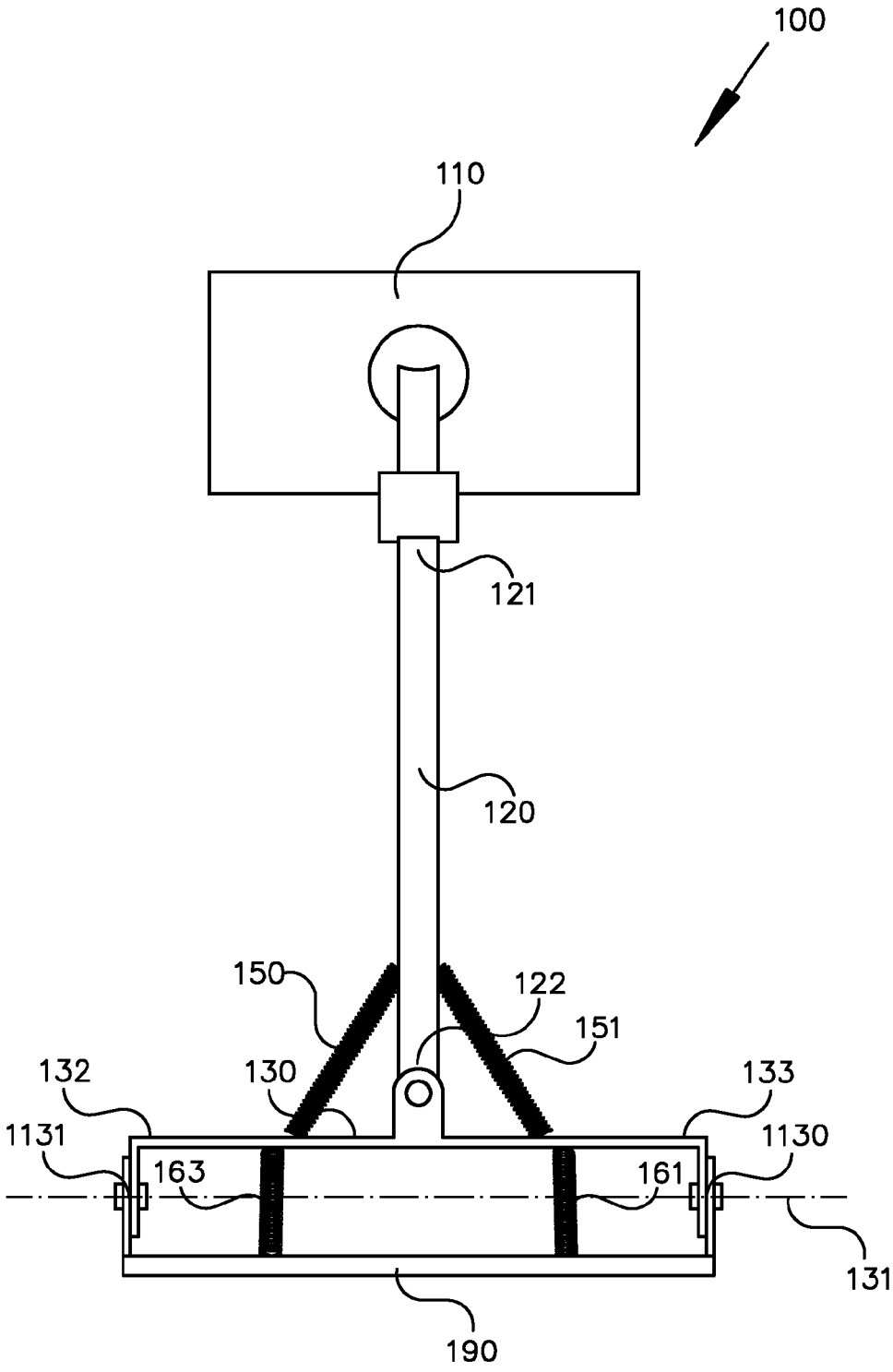
FIG. 8 shows a second preferred embodiment of the device of the invention in a view from the rear.
Figure 9:
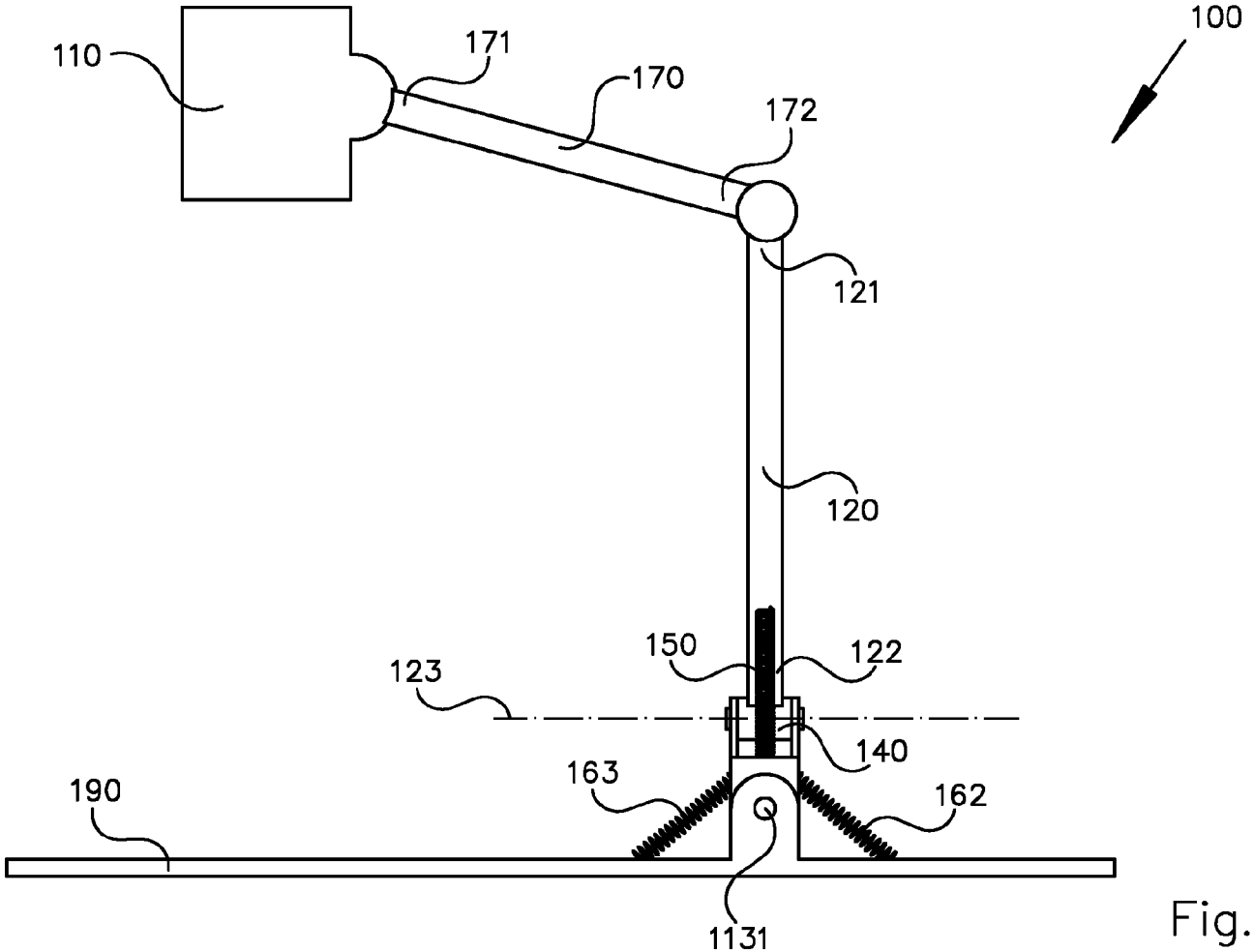
FIG. 9 shows a second preferred embodiment of the device of the invention in a view from the side.
Figure 10:
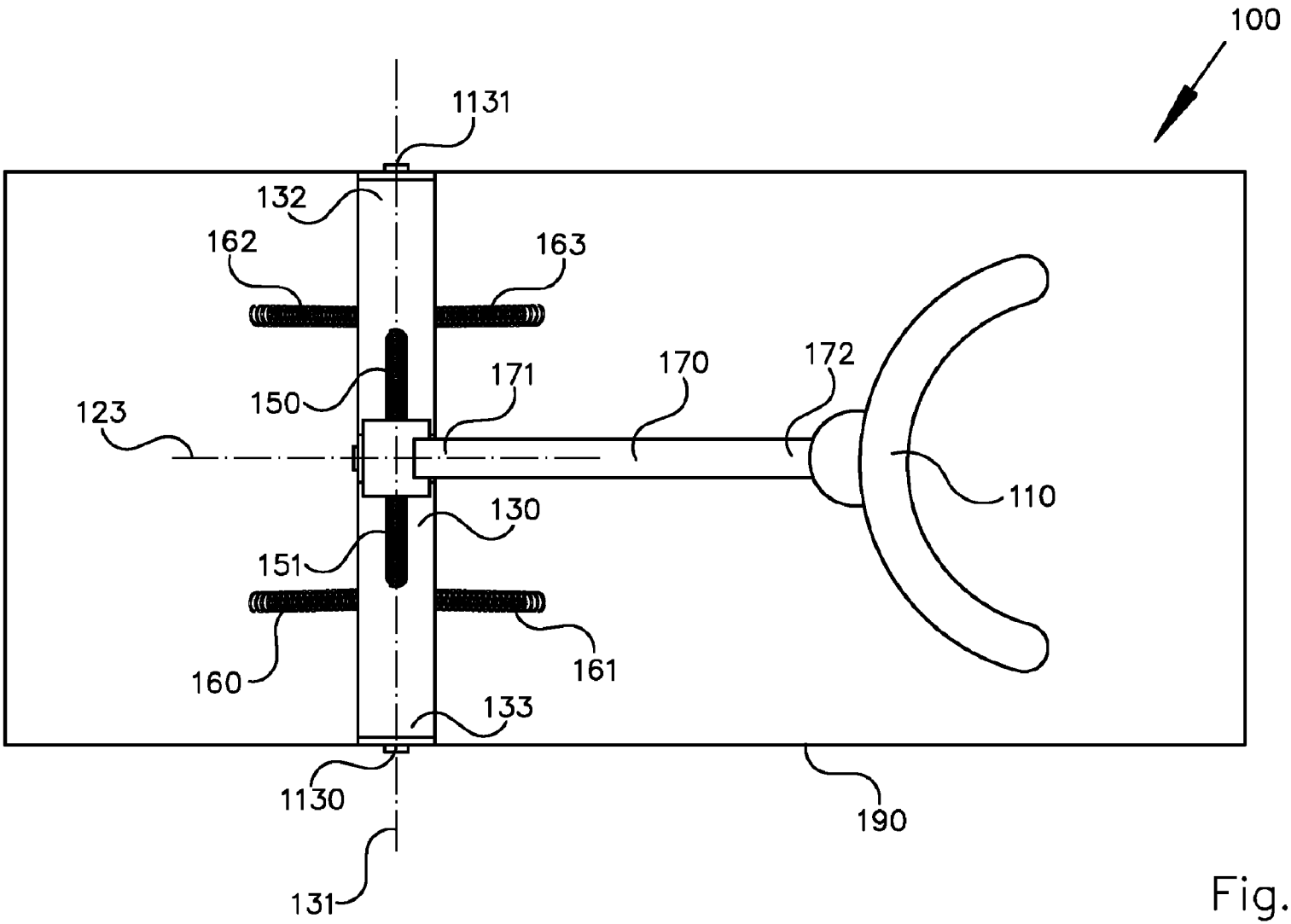
FIG. 10 shows a second preferred embodiment of the device in a view from above.

The devices 100 of the invention, as shown in FIGS. 1 to 10, for training the musculature of the human locomotor system, each include a support unit 110 which is attached at one end to a holding arm 120 and at the other end can be releasably attached to a patient. The holding arm 120 is at least indirectly mounted, at its bottom end 122 remote from the support unit 110, on a carrier chassis 190 by means of at least one resilient element 160, 161, 162, 163, or 165. A resilient element 160, 161, 162, 163, or 165 is coupled to at least one stabilizing assembly 1130, 1131 or 140, which not only prevents torsion of the holding arm about its longitudinal axis but also restricts movement of the holding arm 120 such that the end 121 of the holding arm 120 remote from the carrier chassis 190 is capable of movement over a predetermined area. As a result, the support unit 110 pivotally attached to the holding arm 120 is capable of movement within a predetermined volume 200.

The embodiments of the invention illustrated have the common feature that the support unit 110 is pivotally attached to one end 171 of a support arm 170, of which the other end 172 is pivotally attached to one end 121 of the holding arm 120.

In the preferred embodiment of the invention shown in FIGS. 1 to 5, a stabilizing assembly 135 includes a motion restrictor 181 acting on the holding arm 120 such that movement of the holding arm 120 is limited. The motion restrictor 181 is formed by a face end of a hollow cylinder 180, inside which the resilient element 165 is disposed. The motion restrictor 181 is therefore annular in shape, so that the said predetermined area is circular in shape.

In the illustrated embodiment, a resilient element 165 is formed by a spiral spring accommodated in the interior of the hollow cylinder 180. As discussed above, in other embodiments, the resilient element 165 may be formed by a block of resilient plastics material accommodated in the interior of the hollow cylinder 180, which is shown, for example, in FIG. 2B.

A stabilizing assembly 135, 145 for limiting the motion of the holding arm 120 comprises two interconnected pivot joints 141, 142; 143, 144, which are arranged such that each allows for movement in a plane perpendicular to the other and permits movement of the support unit 110 in two directions of rotation, again mutually at right angles. A part 141 of a first pivot joint 141, 142 is firmly attached at least indirectly to the carrier chassis 190, and a part 143 of the second pivot joint 143, 144 is pivotally connected at least indirectly to the holding arm 120.

The indirectly pivotal connection 135 between the part 143 of the second universal joint 143, 144 and the holding arm 120 comprises two pivot joints 136, 137; 138, 139, which are each arranged so as to allow for movement in a common plane.

In the embodiment of the invention shown in FIGS. 6 to 10, a stabilizing assembly 1130, 1131; 140 includes a carrier element 130 mounted for rotation about its longitudinal axis 131. The bottom end 122 of the holding arm 120 is pivotally connected to the carrier element 130. The swivel axis 123 of the holding arm 120 is at right angles to the longitudinal axis 131 of the carrier element 130. The carrier element 130 is in the form of an elongated panel that is connected at each end 132, 133 to the carrier chassis 190 via a pivot joint 1130, 1131.

In the illustrated embodiment, two resilient elements 160, 161, 162, 163 are located opposite each other and are expandable in opposite directions, each of the resilient elements being connected at one end to the carrier element 130 and at the other end to the carrier chassis 190. These resilient elements cooperate so as to urge the carrier element 130 into a predetermined home position.

Furthermore, two resilient elements 150, 151 located opposite each other and expandable in opposite directions are each connected at one end to the carrier element 130 and at the other end to the holding arm 120, cooperating so as to urge the holding arm into a predetermined home position.

The pivot joints 1130, 1131 for pivotal mounting of the carrier element 130 and the pivot joint 140 for pivotal mounting of the holding arm 120 are each provided with an element that limits the pivot angle, so that the end 121 of the holding arm 120 remote from the carrier chassis 190 is capable of movement over a predetermined area and the support unit 110 pivotally attached to the holding arm 120 is thereby capable of movement within a predetermined volume 200.

The exemplary embodiments of the invention described above are intended merely to provide a better understanding of the teaching of the invention defined in the claims, which teaching is as such not restricted to said exemplary embodiments.

What is claimed is:

1. A device for training the musculature of the human locomotor system, comprising:

a support unit which is attached at one end to a holding arm and at the other end can be releasably attached to a patient, wherein said holding arm is at least indirectly mounted, at its bottom end remote from the support unit, on a carrier chassis by means of at least one resilient element coupled to at least one rigid, inelastic stabilizing assembly, which prevents torsion of said holding arm about its longitudinal axis and also restricts movement of said holding arm such that the end of said holding arm remote from said carrier chassis is capable of movement over a predetermined area and said support unit pivotally attached to said holding arm is thereby capable of movement within a predetermined volume.

2. The device as defined in claim 1, wherein said support unit is pivotally attached to one end of a support arm, the other end of the support arm being pivotally attached to one end of said holding arm.

3. The device as defined in claim 1, wherein the at least one stabilizing assembly for limiting the motion of said holding arm includes a motion restrictor acting on said holding arm.

4. The device as defined in claim 3, wherein said motion restrictor is annular in shape, so that the said predetermined area is circular in shape.

5. The device as defined in claim 4, wherein said motion restrictor is formed by a face end of a hollow cylinder, inside which said resilient element is disposed.

6. The device as defined in claim 3, wherein said motion restrictor is designed so as to configure said predetermined area as a polygon.

7. The device as defined in claim 1, wherein the at least one resilient element includes a spiral spring.

8. The device as defined in claim 1, wherein the at least one resilient element includes a block of resilient plastics material.

9. The device as defined in claim 1, wherein the at least one stabilizing assembly for limiting the motion of said holding arm comprises two interconnected pivot joints, which are arranged such that each allows for movement in a plane perpendicular to the other and permits movement of the support unit in two directions of rotation, mutually at right angles, a part of the first pivot joint being firmly attached at least indirectly to said carrier chassis, and a part of the second pivot joint being pivotally connected at least indirectly to said holding arm.

10. The device as defined in claim 9, wherein an at least indirectly pivotal connection between said part of the second pivot joint and said holding arm comprises two pivot joints, which are each arranged so as to allow for movement in a common plane.

11. The device as defined in claim 1, wherein said at least one stabilizing assembly includes a carrier element mounted for rotation about its longitudinal axis, the bottom end of said holding arm being pivotally connected to said carrier element.

12. The device as defined in claim 11, wherein a swivel axis of said holding arm is at right angles to the longitudinal axis of said carrier element.

13. The device as defined in claim 11, wherein said carrier element is in the form of an elongated panel that is connected at each end to said carrier chassis via a pivot joint.

14. The device as defined in claim 11, wherein at least one expandable and compressible element is provided which is connected at one end to said carrier element and at the other end to said carrier chassis for the purpose of urging said carrier element into a predetermined home position.

15. The device as defined in claim 14, wherein two resilient elements are located opposite each other and are expandable in opposite directions, each of said two resilient elements being connected at one end to said carrier element and at the other end to said carrier chassis, said two resilient elements cooperate so as to urge said carrier element into said predetermined home position.

16. The device as defined in claim 11, wherein one expandable resilient element and one compressible resilient element are provided, each connected at one end to said carrier element and at the other end to said holding arm so as to urge said holding arm into a predetermined home position.

17. The device as defined in claim 16, wherein two resilient elements located opposite each other and expandable in opposite directions are provided, each connected at one end to said carrier element and at the other end said holding arm, cooperating so as to urge said holding arm into a predetermined home position.

18. The device as defined in claim 11, wherein a pivot joint for pivotal mounting of said carrier element and a pivot joint for pivotal mounting of said holding arm are each provided with an element that limits a pivot angle, so that the end of said holding arm remote from said carrier chassis is capable of movement over said predetermined area and said support unit pivotally attached to said holding arm is thereby capable of movement within said predetermined volume.

19. The device as defined in claim 1, wherein the at least one rigid, inelastic stabilizing assembly comprises first and second inextensible members pivotally coupled to each other and configured to prevent said torsion of the holding arm about its longitudinal axis.

20. A muscle training apparatus, comprising:

a support unit for supporting a patient during a training exercise;

a holding arm coupled to the support unit and pivotally mounted on a carrier chassis via a resilient element; and a rigid, inelastic stabilizing assembly coupled to the holding arm to prevent torsion of the holding arm about its longitudinal axis, and to restrict movement of the holding arm such that the end of the holding arm remote from the carrier chassis is capable of movement over a predetermined area and the support unit pivotally attached to the holding arm is capable of movement within a predetermined volume.

21. The apparatus of claim 20, wherein the stabilizing assembly is configured to limit the holding arm to motion within a plurality of mutually perpendicular planes.

22. The apparatus of claim 21, wherein the stabilizing assembly comprises first and second interconnected pivot joints arranged such that each allows for movement in a plane perpendicular to the other.

23. The device as defined in claim 22, wherein movement of the holding arm is coupled to the movement of the first and second pivot joints by third and fourth coplanar pivot joints.

24. The apparatus of claim 20, further comprising a motion restrictor configured to limit the pivotal motion of the holding arm about the resilient element.

25. The apparatus of claim 24, wherein the motion restrictor comprises a cylindrical tube disposed around the resilient element and extending at least partially up the holding arm.

26. The apparatus of claim 20, wherein the holding arm is coupled to the support unit by a support arm pivotally disposed therebetween.

* * * * *